US005894187A

United States Patent [19]

Tomihari

[11] Patent Number: 5,894,187

[45] Date of Patent: Apr. 13, 1999

[54] FIELD EMISSION COLD CATHODE HAVING CONCENTRIC CATHODE AREAS AND FEEDER AREAS, AND CATHODE RAY TUBE HAVING SUCH A FIELD EMISSION COLD CATHODE

[75] Inventor: Yoshinori Tomihari, Tokyo, Japan

[73] Assignee: NEC Corporation, Tokyo, Japan

[21] Appl. No.: 08/882,750

[22] Filed: Jun. 26, 1997

[30] Foreign Application Priority Data

Jun. 27, 1996 [JP] Japan ..... 8-167374

[51] Int. Cl.[6] ..... H01J 1/02

[52] U.S. Cl. ..... 313/309; 313/336; 313/495

[58] Field of Search ..... 313/309, 336, 313/351, 495, 496, 497

[56] References Cited

U.S. PATENT DOCUMENTS

| | | | |
|---|---|---|---|
| 5,194,780 | 3/1993 | Meyer | 315/169.3 |
| 5,502,347 | 3/1996 | Dworsky et al. | 313/309 |
| 5,635,791 | 6/1997 | Vickers | 313/309 |
| 5,666,024 | 9/1997 | Vickers | 313/494 |
| 5,726,530 | 3/1998 | Peng | 313/495 |
| 5,767,619 | 6/1998 | Tsai et al. | 313/495 |

FOREIGN PATENT DOCUMENTS

| | | |
|---|---|---|
| 912624 | 8/1991 | European Pat. Off. . |
| 0-461990 | 12/1991 | European Pat. Off. . |
| 7 21903 | 1/1995 | Japan . |
| 7104244 | 4/1995 | Japan . |
| 7153369 | 6/1995 | Japan . |
| 7282716 | 10/1995 | Japan . |
| 7320632 | 12/1995 | Japan . |

OTHER PUBLICATIONS

Patent Abstract of Japan, vol. 095, No. 009, Oct. 31, 1995.

Patent Abstract of Japan, vol. 095, No. 004, Jan. 24, 1995.

*Primary Examiner*—Nimeshkumar D. Patel

*Attorney, Agent, or Firm*—Sughrue, Mion, Zinn, Macpeak & Seas, PLLC

[57] ABSTRACT

A field emission cold cathode comprises a silicon substrate, a first insulation layer defining peripheries of a first and second feeder area disposed concentric with each other, a cathode area having a plurality of conical emitters overlying the first insulation layer, and a gate electrode layer having a plurality of openings each for applying electric field to each of the conical emitter. The cathode area has a narrower width than the width of the underlying insulating zone, wherein the cathode area has peripheries apart by fixed distance L from the peripheries of the feeder area. In this configuration, a uniform emitter current can be attained among the emitters to thereby obtain a high luminescence and high resolution CRT.

6 Claims, 8 Drawing Sheets

FIELD EMISSION COLD CATHODE HAVING CONCENTRIC CATHODE AREAS AND FEEDER AREAS, AND CATHODE RAY TUBE HAVING SUCH A FIELD EMISSION COLD CATHODE

BACKGROUND OF THE INVENTION (a) Field of the Invention

This invention relates to a field emission cold cathode for use in an electron gun for a cathode ray tube (hereinafter referred to as a "CRT") and a monitor display unit having a high luminance and a high resolution on a screen.

(b) Description of the Related Art

A thermionic (hot) cathode has been generally used as a conventional electron source for an electron gun in a CRT. Today, a monitor display unit for computers having a high luminance and a high resolution is demanded, which requests the electron gun to operate under a current density as high as the critical density of the thermionic cathode.

On the other hand, although electronic components are generally requested to consume less electric power and to be less environmentally hazardous, it is difficult for an electron source having the thermionic cathode to satisfy the request for the lower electric power. Therefore, a new type of electron source capable of satisfying the request is sought for.

A new type of electron gun for a CRT, which employs a field emission cold cathode, has been proposed in JP-A-7 (1995)-21903, for example. FIG. 1A is a cross-sectional view of the proposed field emission cold cathode, and FIG. 1B is a schematic top plan view an showing the relative location between a cathode area and a feeder area as viewed in the direction perpendicular to the layers in the field emission cold cathode.

An insulating zone 29 implemented by a first insulation layer or field oxide film extending along an overlying cathode area 34 is formed on a silicon substrate 27. The insulating zone 29 has a substantially circular outer periphery apart radially outside by distance L from the outer periphery of the cathode area 34. A resistance layer 30, which is electrically connected with the silicon substrate 27 through a feeder area 28 of an annular substrate area, is formed on the entire surface including the surfaces of the insulating zone 29 and the feeder area 28. A second insulation layer 31 and a gate electrode layer 32 are formed on the resistance layer 30. A multiplicity of substantially cylindrical holes are formed in a circular cathode area 34 overlying the insulating zone 29 from the surface of the gate electrode layer 32 to the bottom of the second insulation layer 31 to expose the surface of the resistance layer 30. A minute conical emitter 33 is disposed in each of the cylindrical holes for emitting electrons.

In operation, when the tips of the conical emitters 33 are subjected to an electric field of about $10^8$ V/cm generated by a voltage applied between the silicon substrate 27 and the gate electrode layer 32, electrons are emitted from the tips of the conical emitters 33 by a tunnel effect. Where the diameter of the cylindrical holes and the thickness of the second insulation layer 31 are both on the order of 1 μm, the electric field obtained in the vicinity of the tips of the conical emitters 33 is on the order of several tens of volts at most.

The silicon substrate 27 and the gate electrode layer 32 function as a parallel plate capacitor for storing electric charge therebetween. The accumulated electric charge may often cause an instantaneous discharge to generate a temporary short-circuit between the emitters 33 and the gate electrode layer 32 due to local deterioration of vacuum or other reason. In this case, the temporary short-circuit may generate a destructively high temperature beyond the melting point of the emitters 33. The resistance layer 30 is provided for the purpose of absorbing the excessive instantaneous current caused by the temporary short-circuit to thereby protect the emitters 33 from a thermal destruction.

The distance L between the feeder area 28 and the cathode area 34 as viewed in the direction perpendicular to the layers is provided to increase the resistance in this part of the resistance layer 30 to lower the voltage drop across the portion of the resistance layer 30 disposed within the span of the cathode area 34.

In the field emission cold cathode as described above, a current density as high as 100 to 1000 A/cm$^2$ can be attained for an emitter density of $10^8$ emitters/cm$^2$, which is 10 to 100 times as high as that of the thermionic cathode. Since electrons are emitted by the tunnel effect in the field emission cold cathode, no heater is needed and accordingly power consumption can be saved. Thus, a monitor display unit having a high luminance and a high resolution with a low electric power consumption is realized for computers by taking these advantages of the field emission cold cathode.

In a field emission cold cathode having a larger cathode area 34, however, there is a tendency in which the electric potential at the conical emitters 33 is higher as they are located nearer to the center of the cathode area 34 or more distant from the feeder area 28. Accordingly, the current which can be taken out of the conical emitters in the vicinity of the center of the cathode area is smaller to degrade the current density.

FIG. 2 shows a calculated current distribution curve within the cathode area 34 shown in FIGS. 1A and 1B. The axis of abscissa shows the distance from the center of the cathode area 34, and the axis of ordinates shows the current in an arbitrary unit. As understood from FIG. 2, the most part of the current is provided from the emitters located near the feeder area 28 or in the vicinity of the outer periphery, whereas the emitters located in the vicinity of the central part of the cathode area 34 contribute little to the emission.

FIG. 3 shows calculated currents against voltages applied between the emitter 33 and the gate electrode layer 32 for two cases: one where the resistance layer 30 is provided as shown in FIGS. 1A and 1B; and the other where the resistance layer is omitted. As understood from FIG. 3, there is a tendency in which the current difference between the two cases becomes larger as the emitter current increases as a whole. The characteristic of the field emission cold cathode shown above requests a higher driving voltage of the cathode, renders the driving circuit complicated, and increases the electric power consumption.

Some measures for improving the above-mentioned unevenness of current within the cathode area 34 are proposed, as in JP-A-7(1995)-153369 and-JP-A-7-282716, for example. FIG. 4 is a cross-sectional view of the field emission cold cathode proposed by the former publication, wherein there are provided an annular cathode line 19 formed on an insulator substrate made of glass, for example, and a plurality of cathode conductor islands 20 formed separately from the annular cathode line 19 within an area encircled by the cathode line 19. The cathode line 19 and the cathode conductor islands 20 are electrically connected through a resistance layer 21 formed on the cathode line 19 and the cathode conductor islands 20. It is recited that the emissions from the conical emitters disposed within the span of the cathode conductor islands 20 as viewed in the direction perpendicular to the layers are uniformalized due to an approximately constant resistance between the conical emitters and the cathode conductor islands 20.

In the field emission field cathode as described above, however, electric charge accumulated between the cathode conductor islands 20 and the gate electrode layer 23 may often be released due to a temporary short-circuit between the conical emitters and the gate electrode layer 23. In such a case, a large discharge current flows along the vertical direction of the resistance layer 21 having a limited resistance in the vertical direction, and causes an excessive current to flow through the conical emitters and destroys them. The destruction often results in a permanent short-circuit failure between the conical emitters and the gate electrode layer 23, causing a fatal defect in the CRT.

In a field emission display device (FED) or a liquid crystal display device (LCD), it is proposed, in JP-A-7-32632 (for FED) and JP-A-7-104244 (for LCD), for example, to provide a plurality of terminals in the scanning block for avoiding voltage drops in the supply lines. Referring to FIG. 5 illustrating the LCD structure shown in the latter publication, gate signal lines each opposed to a common electrode 24, with an intervention of a LCD plate therebetween, extend along the horizontal direction of a display screen as scanning metallic lines. A plurality of terminals are provided for the common electrode 24 to thereby receive separately adjusted voltages. Specifically, the voltages separately adjusted by a plurality of electric sources 25 and 26 are supplied to the respective terminals to form a voltage slope in the common electrode 24. Thus, if uneven voltages are applied by the switching devices disposed along the gate signal lines, the uneven voltages and hence unevenness of luminance in the display screen are compensated by the configuration of the plurality of terminals. Voltage differences in the scanning lines near and remote from the voltage source occur due to the voltage drops occurring in the signal lines, although the voltage drops might be desired to be reduced to zero and are in fact unavoidable in its nature.

Referring back to FIGS. 1A and 1B, the slope of voltages occurring within the cathode area 34 shown in these figures is caused by the resistance layer 30 extending underneath the conical emitters 33. However, the resistance layer 30 is provided for the purpose of suppressing an excessive current flowing in the event of temporary short-circuit between the emitters 33 and the gate electrode layer 32. Therefore, it is unreasonable to eliminate the resistance layer 30 in a field emission cold cathode, different from the above-described examples for a LCD in which the resistance in the signal line may be desired to zero.

SUMMARY OF THE INVENTION

It is an object of the present invention to improve the uneven emission of electrons within a cathode area in the conventional field emission cold cathode for a CRT, to thereby provide a monitor display unit having a high luminance, a high resolution and a low electric power consumption.

The present invention provides a field emission cold cathode comprising: a conductive substrate; a first insulation layer selectively formed on the conductive substrate for defining peripheries of a plurality of feeder areas on the conductive substrate; a resistance layer, a second insulation layer and a gate electrode layer consecutively formed on the first insulating layer and the annular feeder areas, the second insulation layer and gate electrode layer having therein a plurality of openings for collectively defining at least one cathode area overlying the first insulation layer, each of the openings exposing a portion of the resistance layer; and an emitter disposed on the resistance layer in each of the openings.

In accordance with the present invention, the plurality of feeder areas uniformalize the emitter current among the emitters in the cathode area, thereby providing a field emission cold cathode for use in a CRT having a high luminescence and a high resolution with a reduced power consumption.

The above and other objects, features and advantages of the present invention will be more apparent from the following description taken in conjunction with the attached drawings.

DESCRIPTION OF THE PREFERRED EMBODIMENTS

Now the present invention is more specifically described by way of preferred embodiments thereof with reference to the accompanying drawings.

Figure 1A:
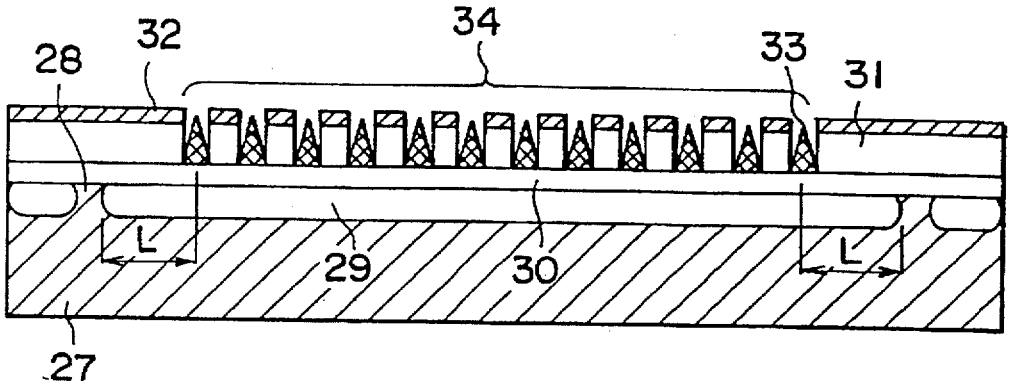
FIG. 1A PRIOR ART
FIGS. 1A and 1B show a cross-sectional view and a schematic top plan view, respectively, of a conventional field emission cold cathode.
Figure 1B:
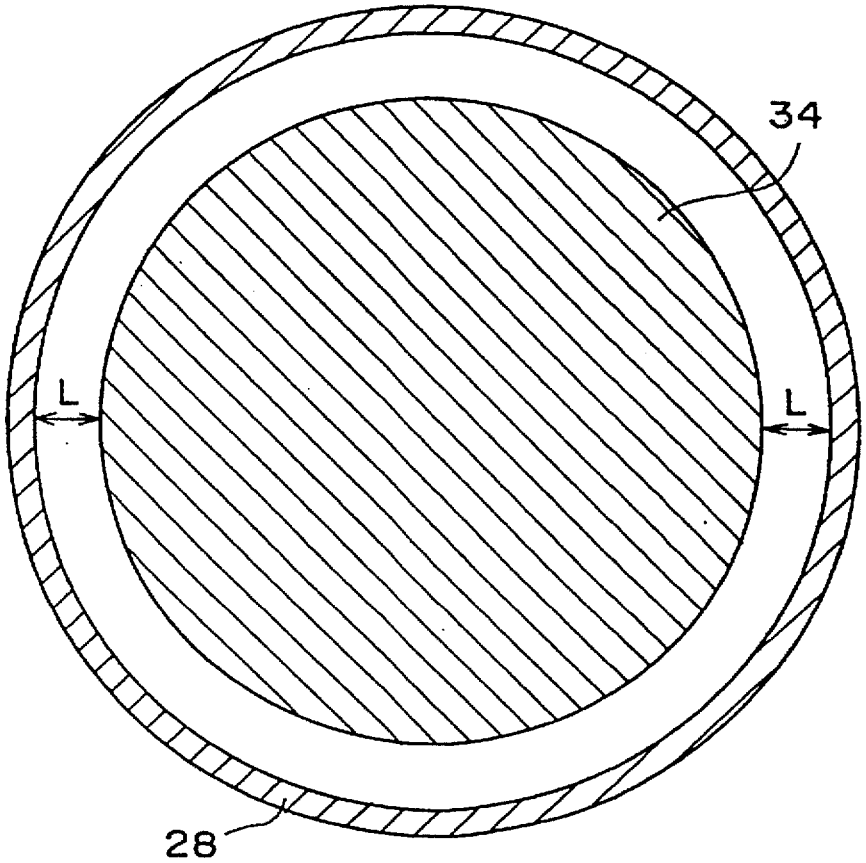
FIG. 1B PRIOR ART
Figure 2:
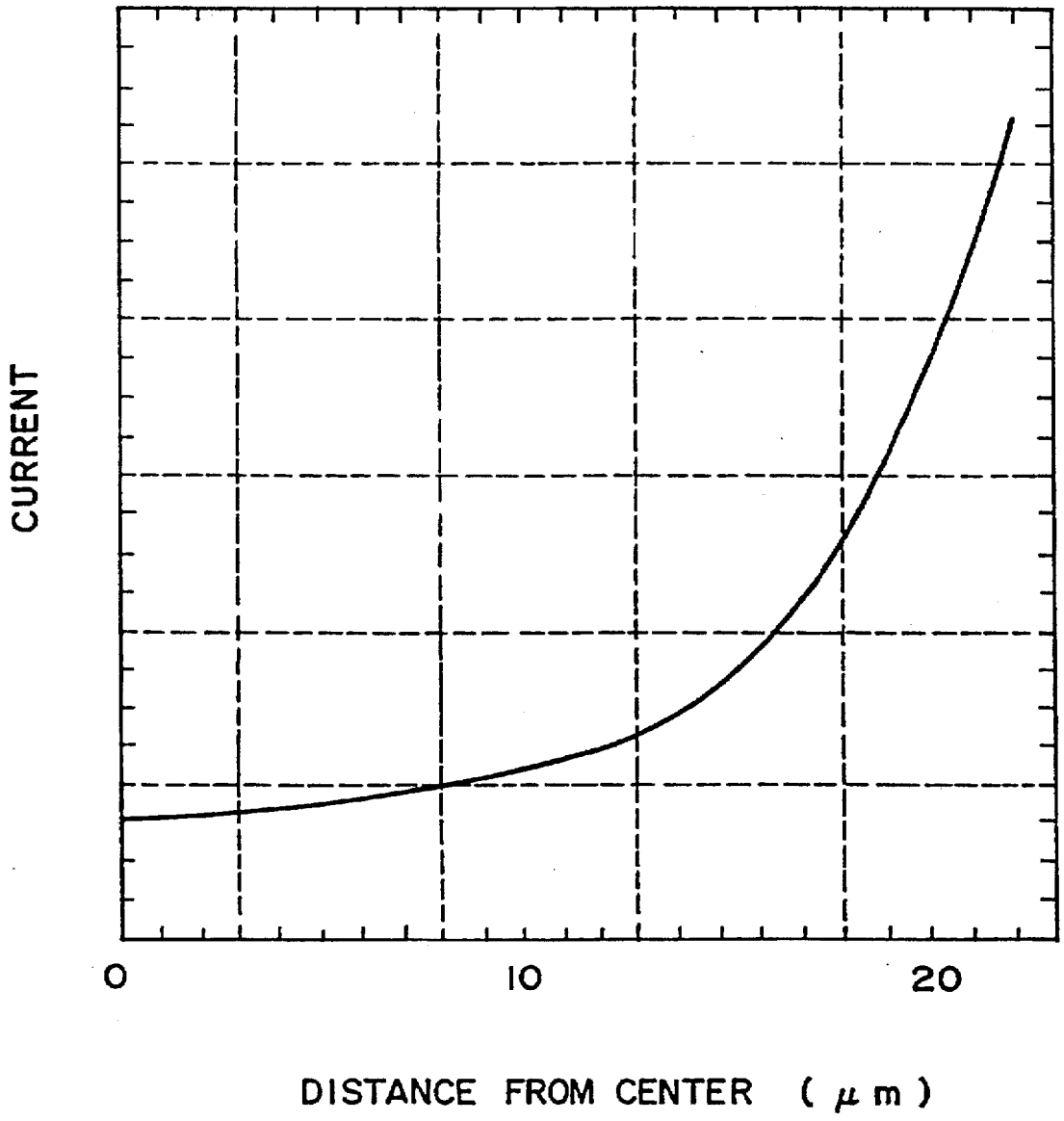
FIG. 2 PRIOR ART
FIG. 2 graphically illustrates a current distribution in the conventional field emission cold cathode of FIG. 1.
Figure 3:
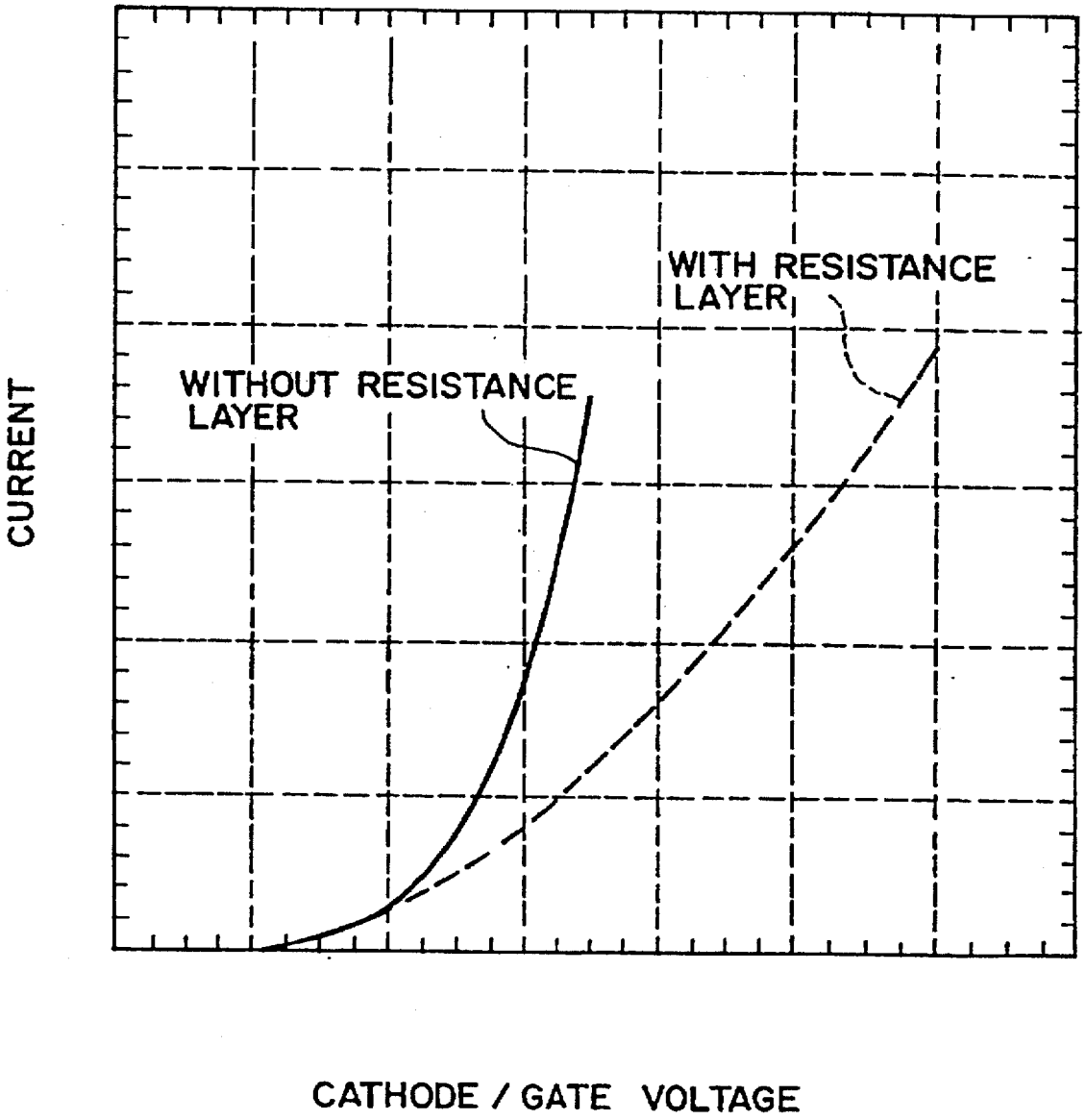
FIG. 3 PRIOR ART
FIG. 3 graphically illustrates the difference in the current characteristic in two cases where a resistance layer is or is not provided in a conventional field emission cold cathode.
Figure 4:
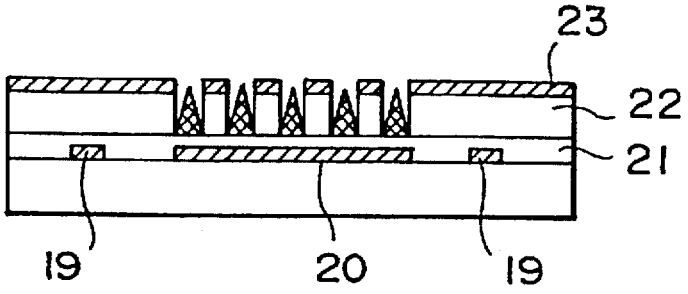
FIG. 4 PRIOR ART
FIG. 4 is a cross-sectional view of another conventional field emission cold cathode proposed in a patent publication.
Figure 5:
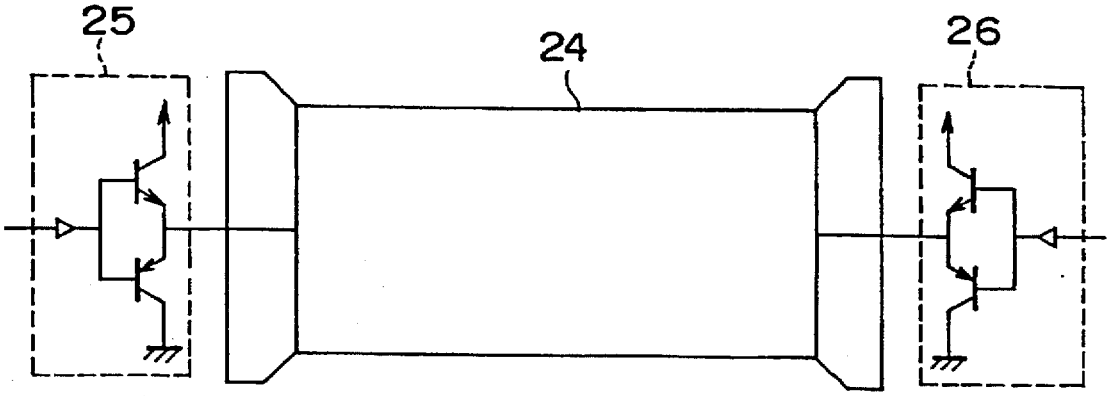
FIG. 5 PRIOR ART
FIG. 5 is a schematic diagram of a conventional LCD proposed in another patent publication.
Figure 6A:
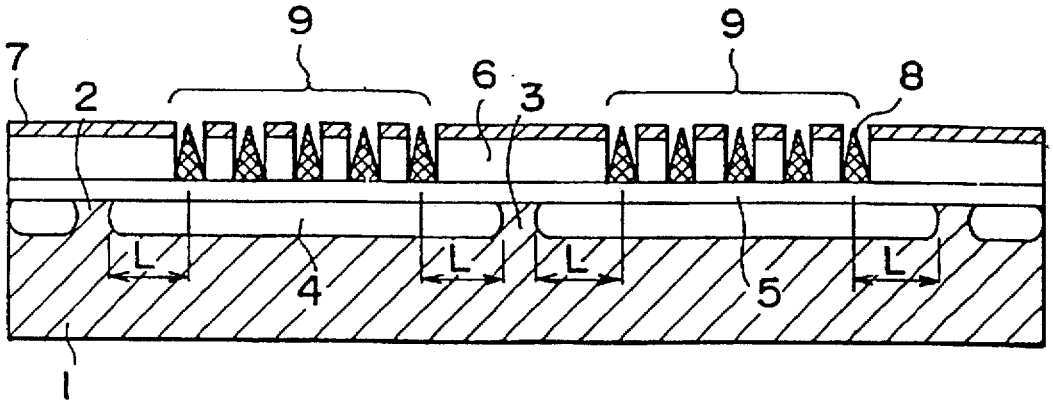
FIGS. 6A and 6B are a cross-sectional view and an enlarged schematic top plan view, respectively, of a field emission cold cathode according to a first embodiment of the present invention.
Figure 6B:
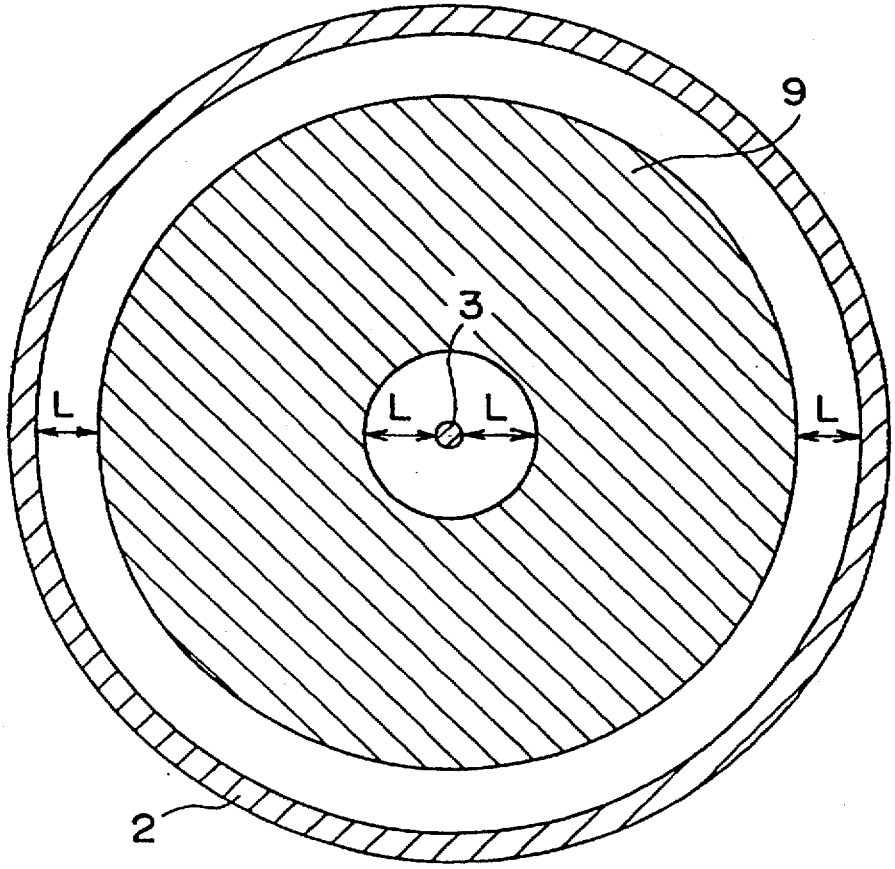

Referring to FIGS. 6A and 6B showing, similarly to FIGS. 1A and 1B, respectively, a field emission cold cathode according to a first embodiment of the invention, a field oxide film or first insulation layer 4 is selectively formed on a silicon substrate 1, defining an insulating zone of a substantially annular shape having an outer periphery located apart radially outside by distance L from the outer periphery of an annular cathode area 9 and an inner periphery located apart radially inside by distance L from the inner periphery of the annular cathode area 9. A resistance layer 5 formed on the field oxide film 4 is electrically connected with the silicon substrate 1, through an annular feeder area 2 having an inner periphery defined by the outer periphery of the annular insulating zone 4 and a central feeder area 3 having a periphery defined by the inner periphery of the annular insulating zone 4.

A second insulation layer 6 and a gate electrode layer 7 are consecutively formed on top of the resistance layer 5. A multiplicity of substantially cylindrical holes are formed in the annular cathode area 9 from the surface of the gate electrode layer 7 to the surface of the resistance layer 5, penetrating the second insulation layer 6. A minute conical emitter 33 is formed in each of the cylindrical holes.

Figure 7A:
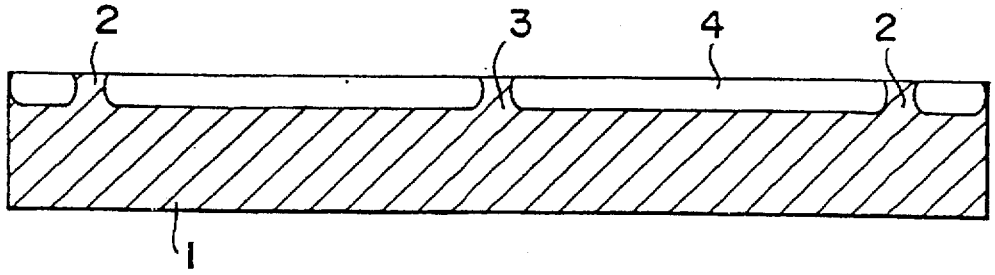
FIGS. 7A, 7B, 7C and 7D are cross-sectional views of the field emission cold cathode of FIGS. 6A and 6B in consecutive steps in a manufacturing process thereof.

A method for manufacturing the field emission cold cathode as shown in FIGS. 6A and 6B will be described with reference to FIGS. 7A to 7D. In FIG. 7A, an annular insulating zone 4 are formed on a silicon substrate 1 by a LOCOS (Local Oxidation of Silicon) technique, for example. In this step, an annular feeder area 2 surrounding the annular insulating zone 4 and a central feeder area 3 surrounded by the annular insulating zone 4 are left on the surface of the silicon substrate 1. The dimensions of the feeder areas 2 and 3 should be determined for an optimum resolution of the CRT having the field emission cold cathode. The diameters of the feeder areas 2 and 3 may be preferably on the order of 100 μm, for instance.

Figure 7B:
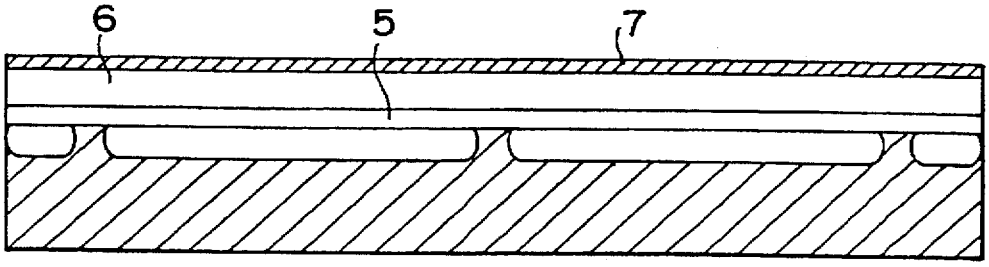

Thereafter, a resistance layer 5 made of polysilicon is deposited by a CVD (Chemical Vapor Deposition) process on top of the insulating zones 4 and the feeder areas 2 and 3 to the thickness of 2000 angstroms. A second insulation layer 6 of 7000 angstrom in thickness and a gate electrode layer 7 of 3000 angstrom in thickness are consecutively formed on the resistance layer 5, as shown in FIG. 7B. The gate electrode layer 7 is preferably made of a high melting point metal such as W or Mo, or a high melting point alloy such as $WSi_2$.

Figure 7C:
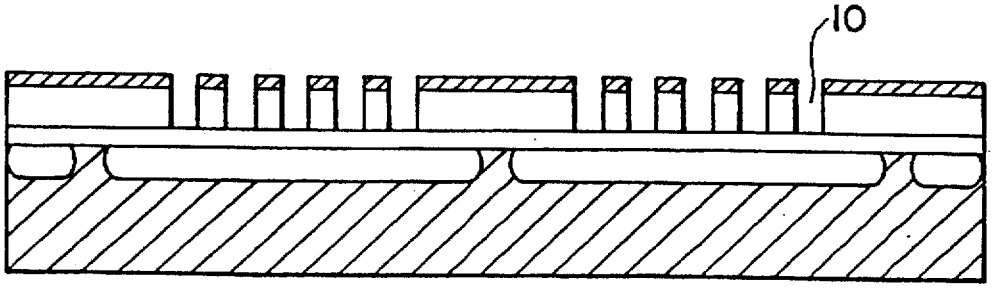
Figure 7D:
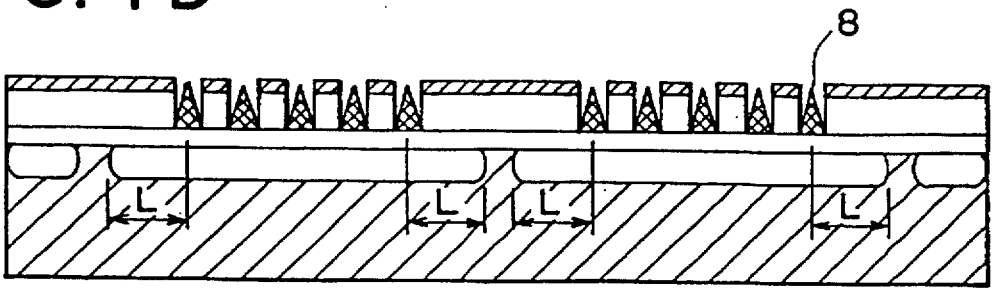

Thereafter, a plurality of cylindrical holes 10, the diameter of which is approximately 1 μm, are formed from the surface of the gate electrode layer 7 to the bottom of the second insulation layer 6 by using a known RIE (Reactive Ion etching) technique etc, as shown in FIG. 7C. A minute conical emitter 8 is then formed in each of the cylindrical holes 10 from a high melting point metal such as W or Mo, which is also used for the gate electrode layer 7. The conical emitters 8 are formed on the resistance layer 5 within the annular cathode area 9 having a boundary disposed apart by distance L from the boundary between the annular insulating zone 4 and the concentric annular feeder area 2 or central feeder area 3, as shown in FIG. 7D.

In the present embodiment, the two feeder areas 2 and 3 supply current from the silicon substrate 1 through the resistance layer 5 in the vertical direction, and from both the outer periphery and the inner periphery of the annular cathode area 9 through the resistance layer 5 in the horizontal direction, to the conical emitters 8. Owing to the structure as described above, substantially all the conical emitters 8 can contribute effectively to the emission of electrons, thereby enhancing the total current up to almost double that of the conventional field emission cold cathode, which was confirmed experimentally.

By the configuration that the outer and inner peripheries of the annular cathode area 9 are spaced by distance L from the boundary between the insulating zone 4 and feeder area 2 or 3, the variations in voltage drop among the conical emitters are lowered and thus the emission density of electrons is uniformalized over the cathode area 9. The resistance layer 5 sandwiched between the conical emitters 8 and the silicon substrate 1 functions for preventing an excessive current from flowing when electric charge accumulated between the gate electrode layer 7 and the silicon substrate 1 is released in the event of a temporary short-circuit occurring therebetween.

Figure 8:
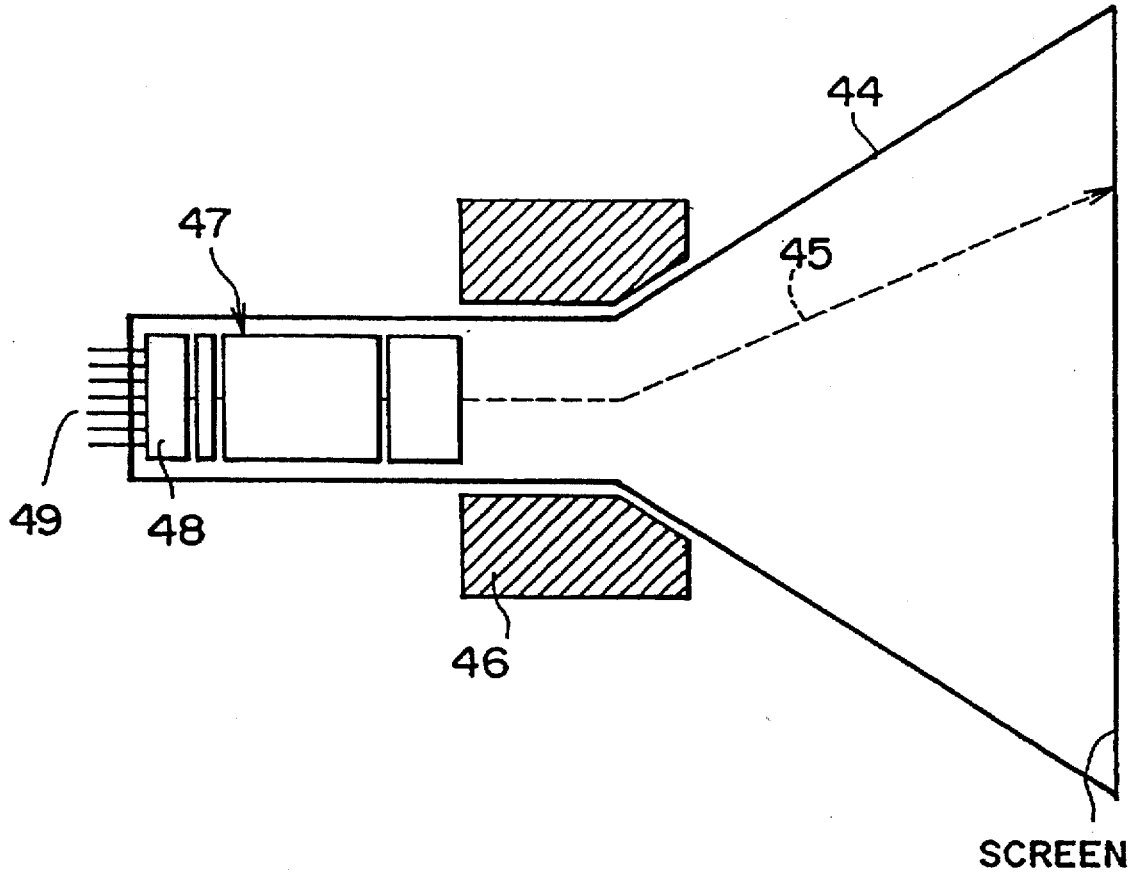
FIG. 8 is a cross-sectional view of a cathode ray tube having a field emission cold cathode of the present invention.

FIG. 8 shows a cross-section of a CRT having a cold emission cold cathode according to the first embodiment of the present invention. The CRT has a glass bulb 44 within which an electron gun 47 having a cathode assembly implemented by the field emission cold cathodes 48 of FIGS. 6A and 6B. The glass bulb 44 can be manufactured by a similar process employed for manufacturing those having a conventional thermionic cathode.

Vacuum in the glass bulb 44 is kept at approximately $10^{-7}$ Torr, which is attained through evacuation by a turbomolecular pump and evaporation of getter material. Electron beam emitted from the cathode assembly 48 is controlled and focussed by the electron gun assembly 47, deflected by a deflection unit 46, and gives excitation to fluorescent material on the screen to display images thereon. Control voltages are supplied from outside to the cathode assembly 48 and the electron gun assembly 47 through lead electrodes 49.

Since the CRT having the field emission cold cathode of the present invention can attain a current density of 10 to 100 times that of the conventional thermionic cathode and double that of the conventional field emission cold cathode, higher luminance and higher resolution can be realized. Further, in the field emission cold cathode according to the present invention, a lower electric power consumption can be attained because of the uniformity of the emission current among the emitters.

Figure 9A:
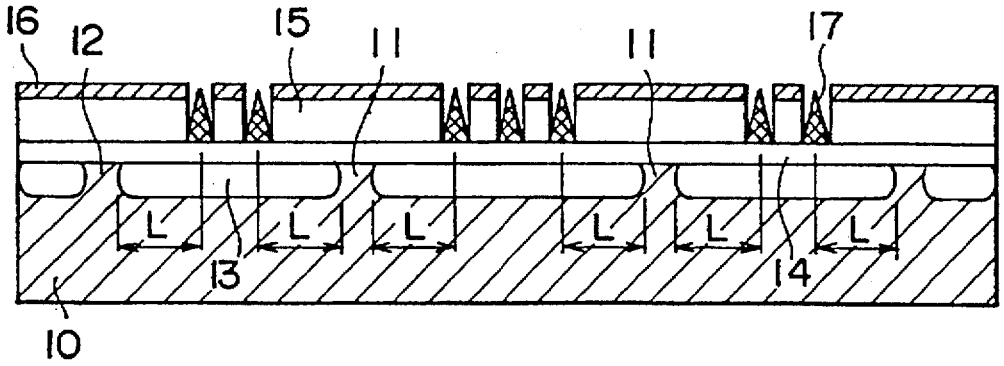
FIGS. 9A and 9B are a cross-sectional view and a schematic top plan view, respectively, of a field emission cold cathode according to a second embodiment of the present invention.
Figure 9B:
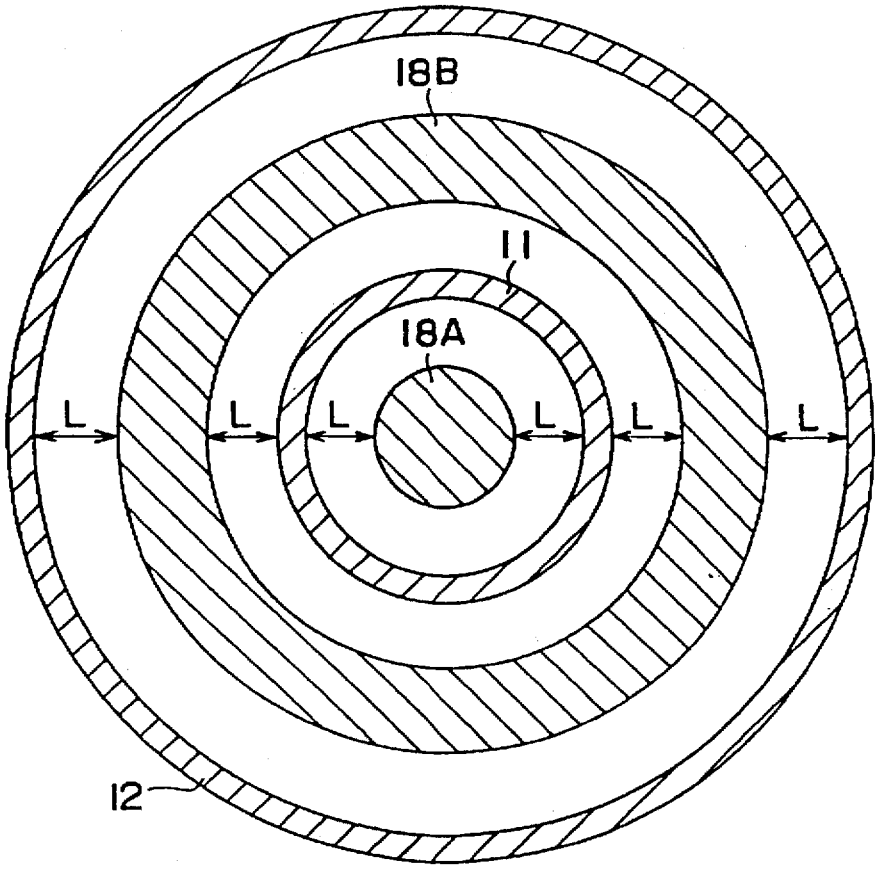

Referring to FIGS. 9A and 9B, a field emission cold cathode according to a second embodiment of the invention has a configuration similar to that of the first embodiment except for the structure of the cathode areas and the feeder areas. The field emission field cathode of the present embodiment has a first, circular cathode area 18A, a second, annular cathode area 18B, and a first and a second annular feeder areas 11 and 12. The first annular feeder area 11 has an inner periphery apart by distance L from the periphery of the first, circular cathode area 18A and an outer periphery apart by distance L from the inner periphery of the second, annular cathode area 18B. The second, annular feeder area 12 has an inner periphery apart by distance L from the outer periphery of the second, annular cathode area 18B.

Uniform emission of electrons can be attained in the present embodiment as in the first embodiment. In a modification of the present embodiment, a third annular cathode area and a third annular feeder area may be consecutively arranged outside the second annular feeder area 12. Further, any pair of annular cathode area and feeder area may be provided outside the added third annular feeder area. A similar configuration may be obtained also from the first embodiment.

Since the above embodiments are described only for examples, the present invention is not limited to the above embodiments and various modifications or alterations can be easily made from the embodiments by those skilled in the art without departing from the scope of the present invention.

What is claimed is:

1. A field emission cold cathode comprising:

a conductive substrate;

a first insulation layer selectively formed on said conductive substrate so as to define peripheries of a plurality of feeder areas formed on said conductive substrate;

a resistance layer, a second insulation layer and a gate electrode layer consecutively formed on said first insulating layer and said plurality of feeder areas, said second insulation layer and said gate electrode layer having therein a plurality of openings, said plurality of openings collectively defining at least one cathode area overlying said first insulation layer, each one of said plurality of openings exposing a portion of said resistance layer; and an emitter disposed on said resistance layer in each one of said plurality of openings.

2. The field emission cold cathode according to claim 1, wherein said plurality of feeder areas comprises:

a circular feeder area and an annular feeder area, wherein said circular feeder area and said annular feeder area are disposed concentrically with each other.

3. The field emission cold cathode according to claim 2, wherein each one of said plurality of feeder areas has a periphery apart by a fixed distance from a periphery of said at least one cathode area as viewed in a direction perpendicular to the layers.

4. The field emission cold cathode according to claim 1, wherein said plurality of feeder areas comprises:

a first annular feeder area and a second annular feeder area, wherein said first annular feeder area and said second annular feeder area are disposed concentrically with each other;

wherein said at least one cathode area comprises:

a circular cathode area encircled by said first annular feeder area and an annular cathode area disposed between said first annular feeder area and second annular feeder area;

as viewed in a direction perpendicular to the layers.

5. The field emission cold cathode according to claim 4, wherein each one of said plurality of feeder areas has a periphery apart by a fixed distance from a periphery of said at least one cathode area as viewed in a direction perpendicular to the layers.

6. A cathode ray tube comprising a field emission cold cathode, wherein said field emission cold cathode comprises:

a conductive substrate;

a first insulation layer selectively formed on said conductive substrate so as to define peripheries of a plurality of feeder areas formed on said conductive substrate;

a resistance layer, a second insulation layer and a gate electrode layer consecutively formed on said first insulating layer and said plurality of feeder areas, said second insulation layer and said gate electrode layer having therein a plurality of openings, said plurality of openings collectively defining at least one cathode area overlying said first insulation layer, each one of said plurality of openings exposing a portion of said resistance layer; and an emitter disposed on said resistance layer in each one of said plurality of openings.

* * * * *